US005743765A

United States Patent [19]

Andrews et al.

[11] Patent Number: 5,743,765

[45] Date of Patent: Apr. 28, 1998

[54] SELECTIVELY METALLIZED CONNECTOR WITH AT LEAST ONE COAXIAL OR TWIN-AXIAL TERMINAL

[75] Inventors: Derek Andrews, Vinkel; Bernardus Paagman, Schijndel, both of Netherlands

[73] Assignee: Berg Technology, Inc., Reno, Nev.

[21] Appl. No.: 503,124

[22] Filed: Jul. 17, 1995

[51] Int. Cl.[6] ..... H01R 13/648

[52] U.S. Cl. ..... 439/608; 439/79; 439/931

[58] Field of Search ..... 439/79, 607, 608, 439/701, 931

[56] References Cited

U.S. PATENT DOCUMENTS

| | | | |
|---|---|---|---|
| 3,958,851 | 5/1976 | Evans | 439/609 |
| 5,102,353 | 4/1992 | Brunker et al. | 439/608 |
| 5,135,405 | 8/1992 | Fusselman et al. | 439/608 X |
| 5,141,454 | 8/1992 | Garrett et al. | 439/931 X |
| 5,178,549 | 1/1993 | Neumann et al. | 439/608 X |
| 5,228,871 | 7/1993 | Goodman | 439/931 X |
| 5,344,341 | 9/1994 | Yoshino | 439/931 X |
| 5,399,104 | 3/1995 | Middlehurst et al. | 439/931 X |

FOREIGN PATENT DOCUMENTS 0 562 691 A1 3/1993 European Pat. Off. .

*Primary Examiner*—Khiem Nguyen
*Attorney, Agent, or Firm*—Daniel J. Long; M. Richard Page

[57] ABSTRACT

Connector provided with at least two adjacent cavities (5, 6) to accommodate terminals (14), the connector having a selectively metallized plastic structure in order to at least partly shield at least one cavity from the other cavities wherein said connector has at least partly the following housing structure between each shielded cavity and its adjacent cavities: a first insulating plastic wall—at least one metal layer—a second insulating plastic wall, said at least one metal layer being provided as a coating on said first and/or said second plastic walls.

16 Claims, 8 Drawing Sheets

SELECTIVELY METALLIZED CONNECTOR WITH AT LEAST ONE COAXIAL OR TWIN-AXIAL TERMINAL

BACKGROUND OF THE INVENTION

The present invention relates to a connector provided with at least two adjacent cavities to accommodate terminals, the connector having a metallized plastic structure in order to at least partly shield at least one cavity from the other cavities.

Such a connector is known from International Patent Application W0 92/11671. The body of the known connector is constructed from a plurality of plates which comprise recesses which form half of the cavities of the connector accommodating terminals in the assembled state. To assemble the known connector the plates are fixed together by suitable fixing means. All plates are metallized with the exception of areas in the recesses. There are at least as many connector parts to be fixed together as there are columns of terminals of the assembled connector. Therefore the known connector is complex, especially, in applications where many columns are needed. In the known connector all terminals are shielded from external electromagnetic radiation. However, since the recesses accommodating the terminals are not metallized to prevent shortcircuits to ground, cross-talk between adjacent terminals, especially those in the same rows, is not prevented which is especially a problem when frequencies are increasing.

In order to prevent cross-talk between adjacent terminals in a connector, U.S. Pat. No. 5,102,353 has disclosed the application cation of a metal insert having a +-shaped cross-section and which can be inserted between four terminals arranged in two columns of two rows.

In order to provide a shielded twin-axial connection in a connector European Patent Application 0,562,691 discloses a twin-axial insert provided with a separate metal external conductor folded around an insulating body.

Dutch Patent Application 9202301 discloses the application of S-shaped metal inserts to be inserted in connectors in order to provide a shielding between adjacent terminals in the connectors.

In the field of connector technology there is a need to avoid the application of separate metal inserts as shielding elements in connectors since they are relatively expensive and have to meet high tolerance requirements.

In the connectors known from U.S. Pat. No. 5,246,385 the application of separate metal inserts to prevent (external) electromagnetic interference is avoided; the connectors known from this Patent are made of different parts some of which are metallized and some of which are not. However, this United States Patent does not disclose connectors in which adjacent terminals are shielded against each other to reduce cross-talk.

Because of the excellent high frequency performance of co-axial and twin-axial connections in connectors there is a need to provide connectors with such connections, however, at the same time under the requirement to reduce manufacturing costs as much as possible.

SUMMARY OF THE INVENTION

Therefore, it is an object of the present invention to provide a connector in which cavities suitable to accommodate at least one terminal are shielded as much as possible from adjacent cavities by the application of metallized plastic parts without the need to use separate metal inserts.

Therefore, according to the invention a connector as defined in the preamble is characterized in that said connector is selectively metallized and comprises at least partly the following housing structure between each shielded cavity and its adjacent cavities: a first insulating plastic wall—at least one metal layer—a second insulating plastic wall, said at least one metal layer being provided as a coating on said first and/or said second plastic walls.

By the provision of such a connector, cavities are shielded from adjacent cavities. The shielding effectiveness depends upon the specific connector design. The more each cavity is enclosed by metal layers on plastic wall parts the higher the shielding effectiveness. The more miniaturization is required, the higher the required shielding effectiveness will be. The higher the applied frequencies the higher the required shielding effectiveness will be.

In a first embodiment the connector comprises at least a first and a second housing part, the first housing part comprising at least one cavity to accommodate one terminal and being selectively metallized at the outside surface surrounding said at least one cavity, the second housing part comprising at least one further cavity to accommodate one further terminal and being selectively metallized at the outside surface surrounding said at least one further cavity, the first and second housing parts being designed in such a way as to be able to be inserted into each other in order to yield said connector comprising at least two adjacent coaxial terminals.

In such an embodiment all cavities may be entirely enclosed by a metal layer and, thus, by a Faraday cage which is very effective against cross-talk between adjacent terminals in said cavities.

The connector of the first embodiment may comprise a comb-like third housing part that can be fixed to said first and second housing parts inserted into each other to provide separating walls between adjacent columns of terminals extending from said first and second housing parts inserted into each other. Such a comb-like third housing part provides for a mechanical protection between adjacent columns of terminals extending from said first and second housing parts inserted into each other.

Preferably said separating walls comprise moulded-in plates. Said moulded-in plates provide for excellent cross-talk reduction between adjacent columns of terminals.

The connector may be surface mounted to a substrate by means of surface mount connection means connected to both the selectively metallized connector and the ground layer on said substrate.

In an other embodiment the connector according to the invention comprises several adjacent cavities to receive terminals, said cavities being separated by cavity walls provided with additional, internally metallized through-holes having predetermined cross-sections and surrounding said cavities. The electrical performance of this embodiment of the invention is less than the electrical performance of the first mentioned embodiment, since there are always unshielded parts between adjacent cavities giving rise to cross-talk problems. However, these unshielded parts may be kept to a minimum in order to reduce cross-talk to a minimum. The advantage of the connector according to the latter embodiment is that it is integrally made and is not made of separate housing parts which do have to meet manufacturing tolerance requirements in order to ease the assembly of the connector.

In a further embodiment the connector may comprise a housing provided with adjacent, internally metallized cavities, and insulating sleeves to be inserted into corresponding cavities and to accommodate corresponding terminals. Alternatively, the connector according to the invention may comprise an insulating housing provided with adjacent cavities, and externally metallized sleeves to be inserted into corresponding cavities and to accommodate corresponding terminals.

The connector according to the invention may be made suitable to accommodate at least one twin-axial connection. To that end the connector according to the invention comprises at least one cavity accommodating a twin-axial insert member externally metallized and electrically contacting a ground layer on the connector's surface, which ground layer also electrically contacts at least one ground terminal adjacent to said twin-ax insert member.

BRIEF DESCRIPTION OF THE DRAWINGS

The present invention will be further explained by referring to some drawings, in which, by way of example only, some embodiments of the present invention are shown.

DETAILED DESCRIPTION OF PREFERRED EMBODIMENTS

Figure 1:
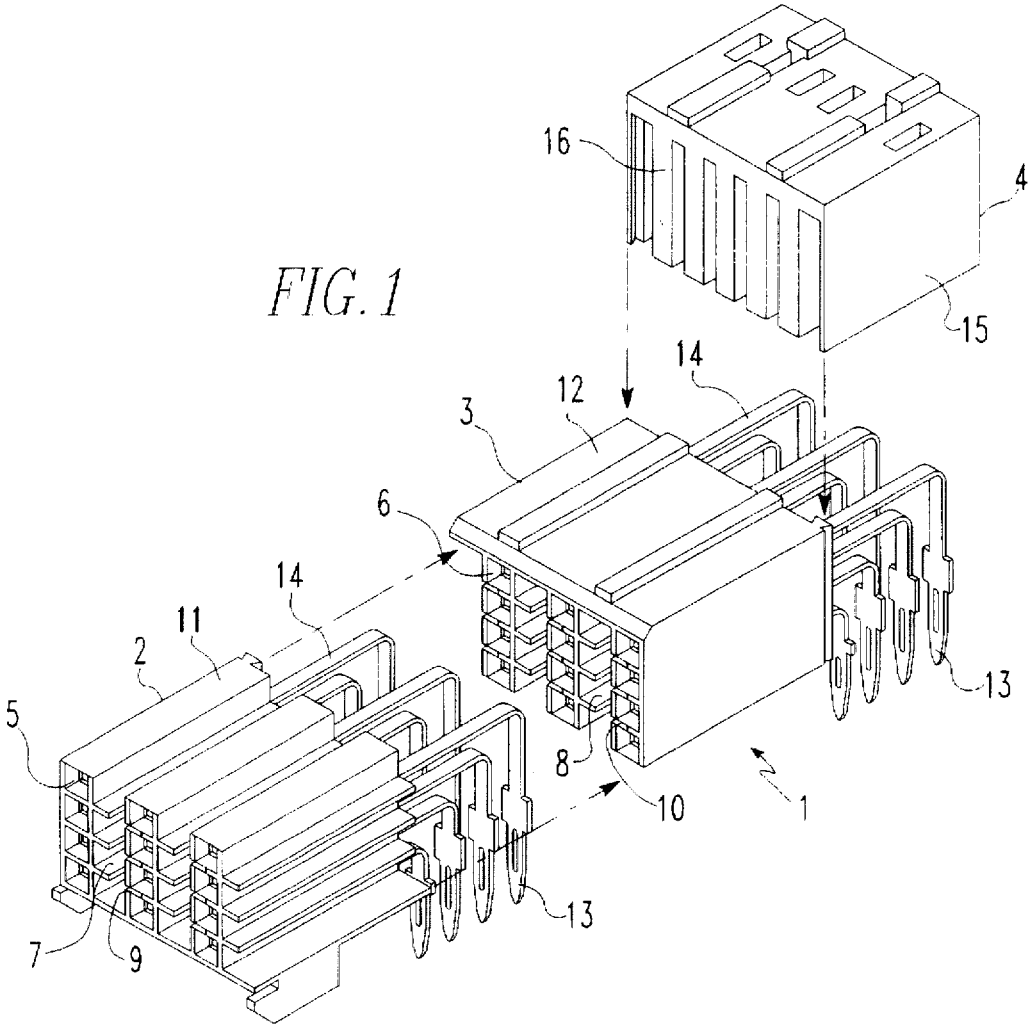
FIG. 1 shows a connector according to the invention consisting of several housing parts to be inserted into each other.

In FIG. 1 a connector according to a first embodiment of the invention is shown. The connector 1 of FIG. 1 comprises three housing parts 2, 3, 4, each preferably molded from an insulating material. The first housing part 2 can be inserted into the second housing part 3, while the third housing part 4 is a tail cover to protect adjacent columns of terminals 14 of the connector 1. The first housing part 2 comprises a metal layer 11 on its outside surface. The cavities 5 of the first housing part are not coated with any metal layer. In the embodiment shown in FIG. 1 the first housing part 2 comprises three columns of four rows of cavities 5. Each cavity 5 comprises a terminal 14. Each column of four cavities 5 comprises rims 7 extending from the external surface of the first housing part 2 parallel to the axial direction of the cavities 5. Opposite the rims 7 the intermediate column and the right-hand column comprise recesses 9 extending parallel to the axial direction of each cavity 5.

The second housing part 3 comprises a metal layer 12 on its outside surface and comprises a structure of also three columns of four rows of cavities 6. Rims 8 extend from the left-hand column and the intermediate column parallel to the axial direction of cavities 6. Opposite to the rims 8 the left-hand column and the intermediate column are provided with recesses 10. Recesses 10 are also provided in the right-hand column of cavities 6 opposite rims 8 in the intermediate column.

The external dimensions of the cavities 5 and the cavities 6, respectively, of the first housing part 2 and the second housing part 3, respectively, are selected in such a way that the first housing part 2 and the second housing part 3 can be inserted into each other, whereby rims 7 will fit into recesses 10 and rims 8 will fit into recesses 9. Inserting the first housing part 2 and the second housing part 3 into each other yields a connector body with six adjacent columns of four rows of coaxial cavities. Each cavity 5, 6 comprises a terminal 14 extending from a rear side of the first and second housing parts 2, 3 inserted into each other.

As shown in FIG. 1 the terminals 14 can be bent 90° in order to allow a right angle connection to a substrate, printed circuit board or the like (not shown).

Each terminal 14 comprises a connecting end 13 which, by way of example, is shown to be a press-fit connection. However, any other way of connecting the terminals 14 to a substrate is possible.

To protect adjacent columns of terminals 14 a third housing part 4, having a form of a tail cover or a comb-like structure, may be provided. The tail cover 4 comprises several intermediate walls to be inserted between adjacent columns of terminals 14. The housing parts 2, 3, 4 may each by provided with appropriate extensions and/or recesses to allow connection between these three housing parts. As shown in FIG. 1 the first housing part 2 is coated with metal layer 11, the second housing part 3 is coated with metal layer 12 and the third housing part 4 is coated with metal layer 15. However, since there may be direct contact between the intermediate walls 16 and the terminals 14, the side surfaces of the walls 16 cannot be metallized since that would cause short circuits.

Figure 2:
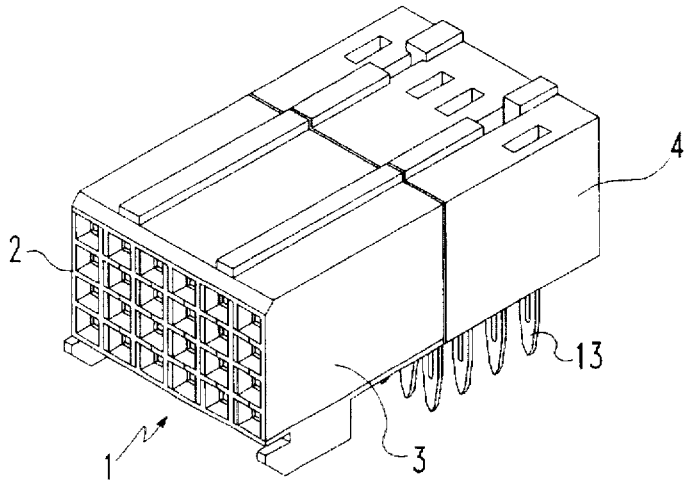
FIG. 2 shows the connector according to FIG. 1 in the assembled state.

FIG. 2 shows the connector 1 of FIG. 1 in the assembled state.

Figure 3:
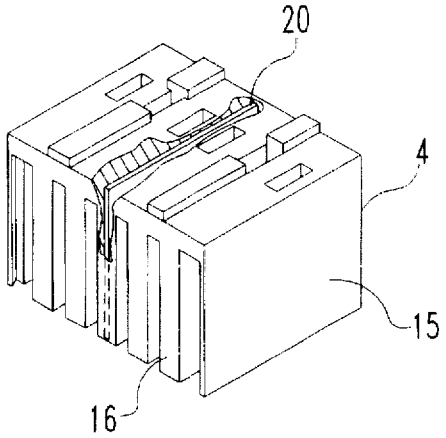
FIG. 3 shows an alternative comb-like third housing part to be used in the connector according to FIGS. 1 and 2.

In order to reduce cross-talk problems between adjacent columns of terminals 14 at the location of the tail cover 4 the intermediate walls 16 of the tail cover 4 may each be provided with moulded-in plates electrically connected to metal layer 15 connected to ground. This is shown in FIG. 3. As an alternative, tail cover 4 may entirely be metallized with metal layer 15 also covering the side surfaces of intermediate walls 16 after which these side surfaces of intermediate walls 16, as well as the inner surfaces of the outside walls of tail cover 4 are coated with an insulating layer to prevent short circuits between terminals 14.

Figure 4:
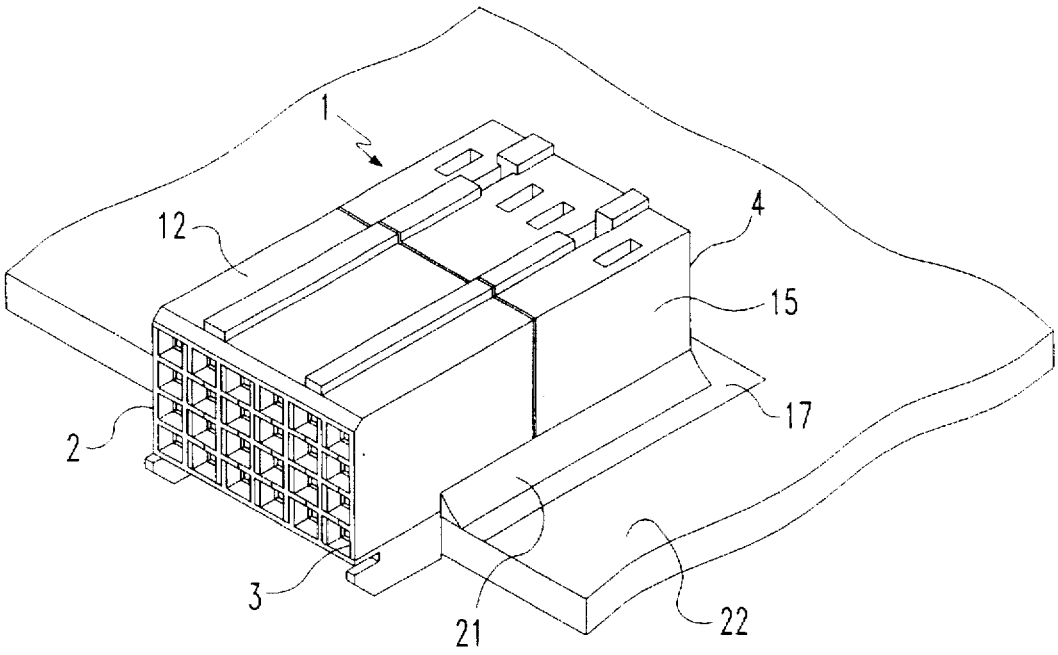
FIG. 4 shows the connector according to FIGS. 1 and 2 surface mounted to a substrate.

FIG. 4 shows a connector according to FIGS. 1 and 2 surface mounted to a substrate 22 which may be a printed circuit board (pcb) or a back plane or the like. The connecting ends 13 (FIGS. 1 and 2) are accommodated in appropriate corresponding holes (not shown) in the substrate 22. The substrate 22 is provided with a ground layer 17. Surface mount connection means 21 are provided to form an electrical contact between ground layer 17 and the outside metal layers 11, 12, 15 of the housing parts 2, 3, 4 of connector 1. Suitable surface mount connection means 21 are known to persons skilled in the art and need no further explanation in the present invention.

Instead of the surface mount connection means 21 shown in FIG. 4, alternatively, press-fit pegs (not shown) mounted on the connector 1 and accommodated in plated holes of the substrate 22 can be used.

Figure 5:
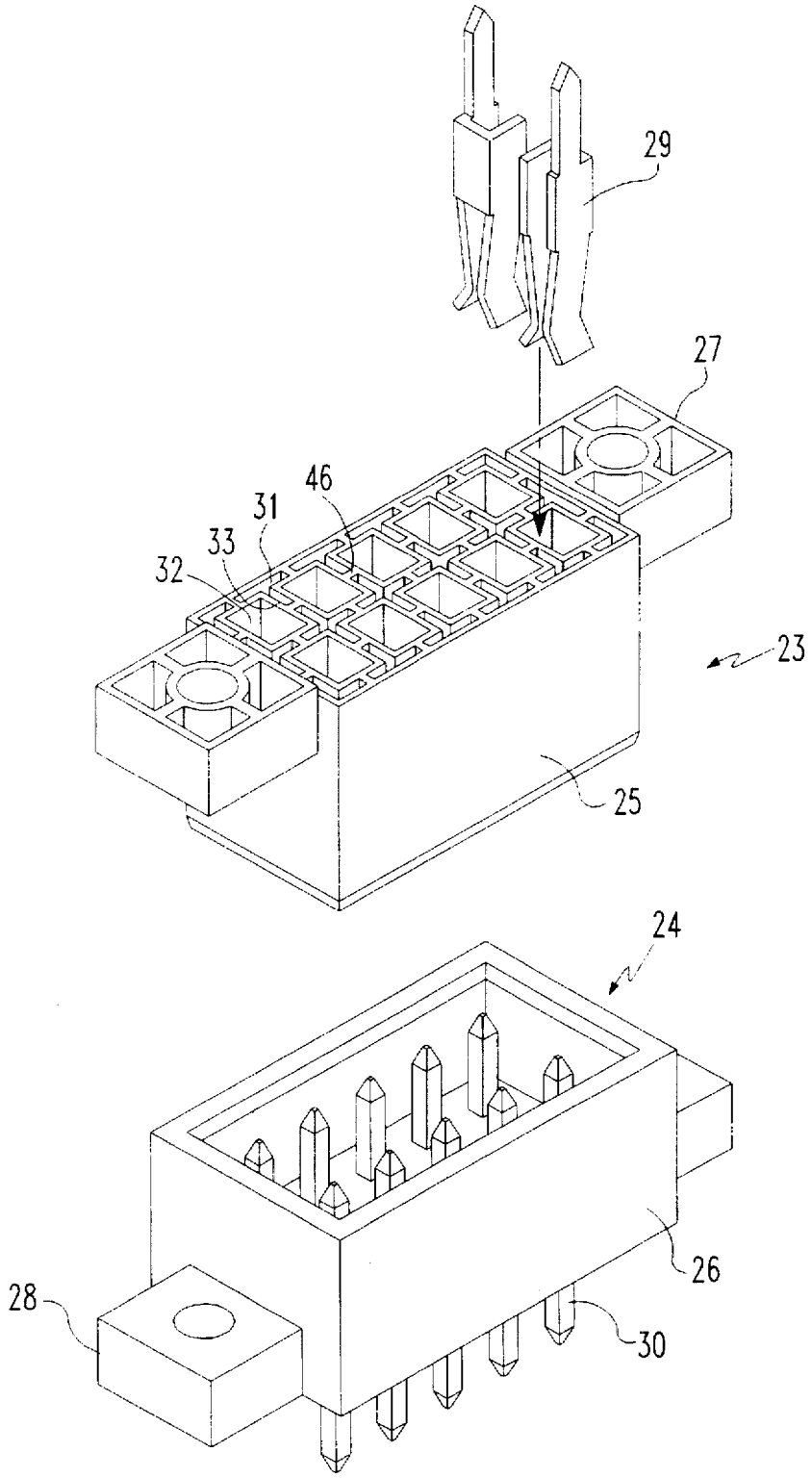
FIG. 5 shows an alternative connector according to the invention.

FIG. 5 shows an alternative embodiment of a connector 23 according to the invention. Connector 23 comprises a housing selectively metallized with metal layer 25.

Moreover, connector 23 comprises cavity walls 33 between cavities 32. The cavity walls 33 are provided with additional through-holes 31. The additional through-holes 31 are internally metallized. The dimensions of the cross-sections of the additional through-holes 31 is chosen in such a way that adjacent cavities 32 are only mechanically connected to each other by bridges 46 which are as small as possible. The dimensions of the bridges 46 follow from the overall mechanical requirements of the connector 23. By choosing the bridges 46 as small as possible as high shielding as possible between adjacent cavities is obtained. Each cavity 32 is designed to accommodate a corresponding terminal 29.

The connector 23 may be provided with extensions 27 to fix the connector 23 to a substrate (not shown).

The connector 23 is designed to be inserted into a mating connector 24 which is also provided with a metal layer 26 at its surface. In the embodiment shown in FIG. 5 the connector 23 comprises female terminals 29 while the connector 24 comprises male terminals 30. Of course, connectors according to the invention are not restricted to these types of terminals. Cavities 32 may be provided with male-type terminals, whereas then the connector 24 may be provided with female-type terminals. Alternatively, both connectors 23 and 24 may be provided with hermaphrodite-like terminals (not shown).

Connector 24 may also be provided with extensions 28 to connect the connector 24 to a substrate (not shown).

Figure 6:
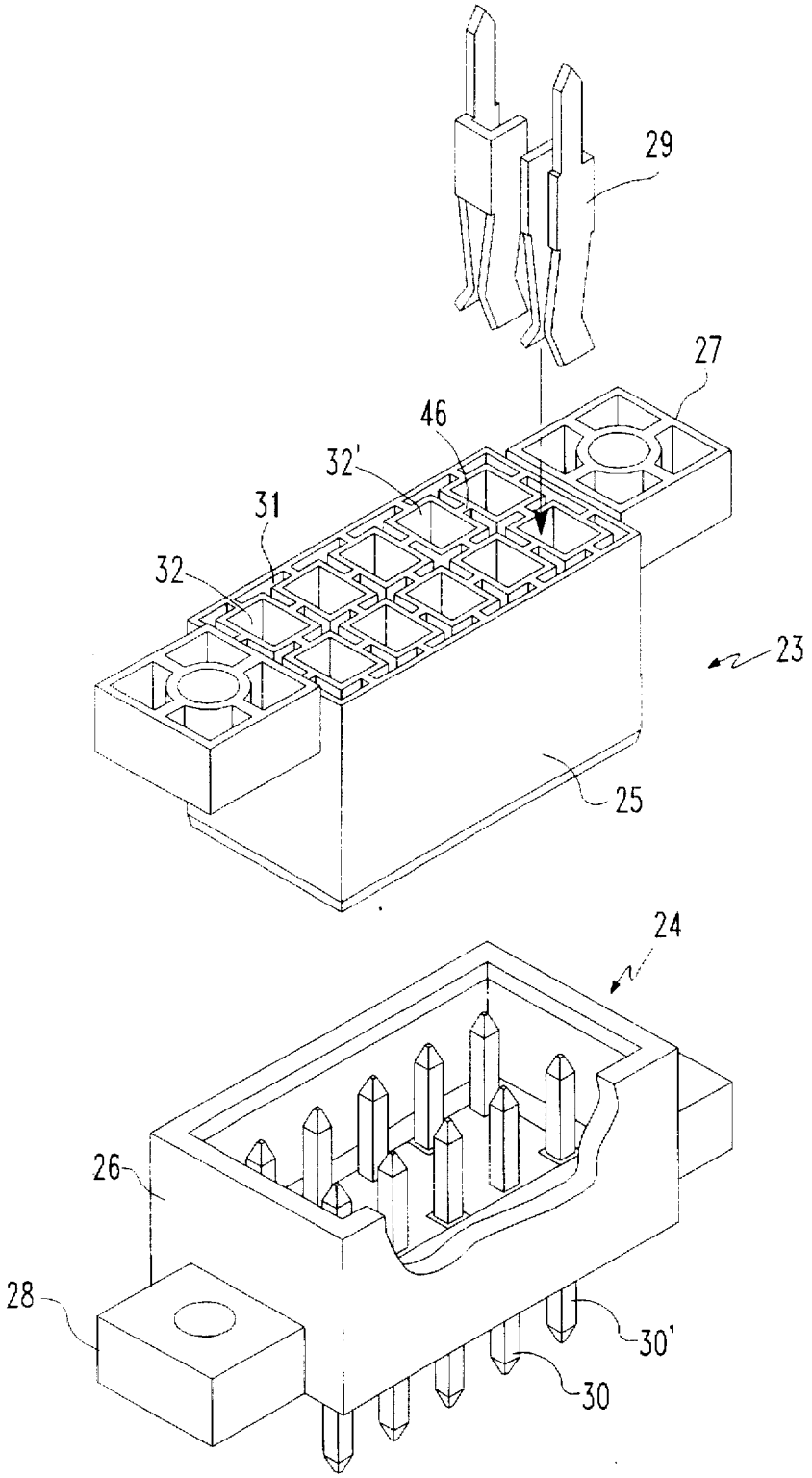
FIG. 6 shows a further alternative embodiment of a connector according to the invention.

FIG. 6 shows a further embodiment of the connector according to the invention. The same reference signs used in FIGS. 5 and 6 refer to the same parts of the connectors shown. In addition to not-metallized cavities 32 the connector 23 according to FIG. 6 also comprises one or more metallized cavities 32'. Besides, connector 24 according to the embodiment of FIG. 6 comprises several terminals 30' which are connected to the ground metal layer 26 covering connector 24. The metal layer inside the metallized cavities 32' of connector 23 electrically contact metal layer 25 on the outside surface of connector 23. Therefore, those terminals 29 inserted into metallized cavities 32' electrically contact ground.

The embodiments of FIGS. 5 and 6 show cavities 32, 32' having square cross-section dimensions. However, cavities of the connector according to the invention may have any shape of cross-section. FIGS. 7*a*, 7*b*, 8*a*, and 8*b* show connectors according to the invention having circular cavities.

Figure 7A:
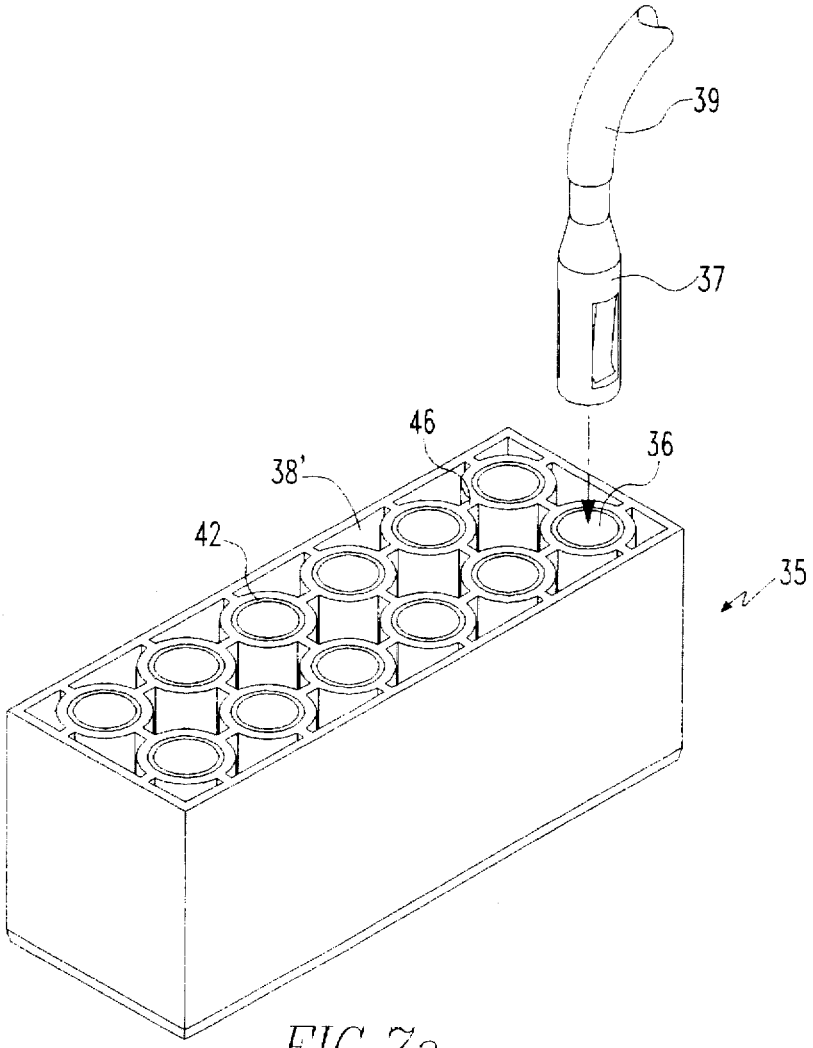
FIGS. 7*a* and 7*b* show further alternative connectors according to the invention.

Connector 35 according to the embodiment of FIG. 7*a* comprises cylindrical cavities 36. The intermediate walls 42 between adjacent cavities 36 comprise additional through-holes 38' which are entirely metallized. Thin bridges 46 mechanically connect adjacent cavities 36. Only at the locations of the thin bridges 46 no electromagnetic shielding is obtained.

Each cavity 36 accommodates a terminal 37. The terminal 37 may be connected to a cable 39 if required.

Figure 7B:
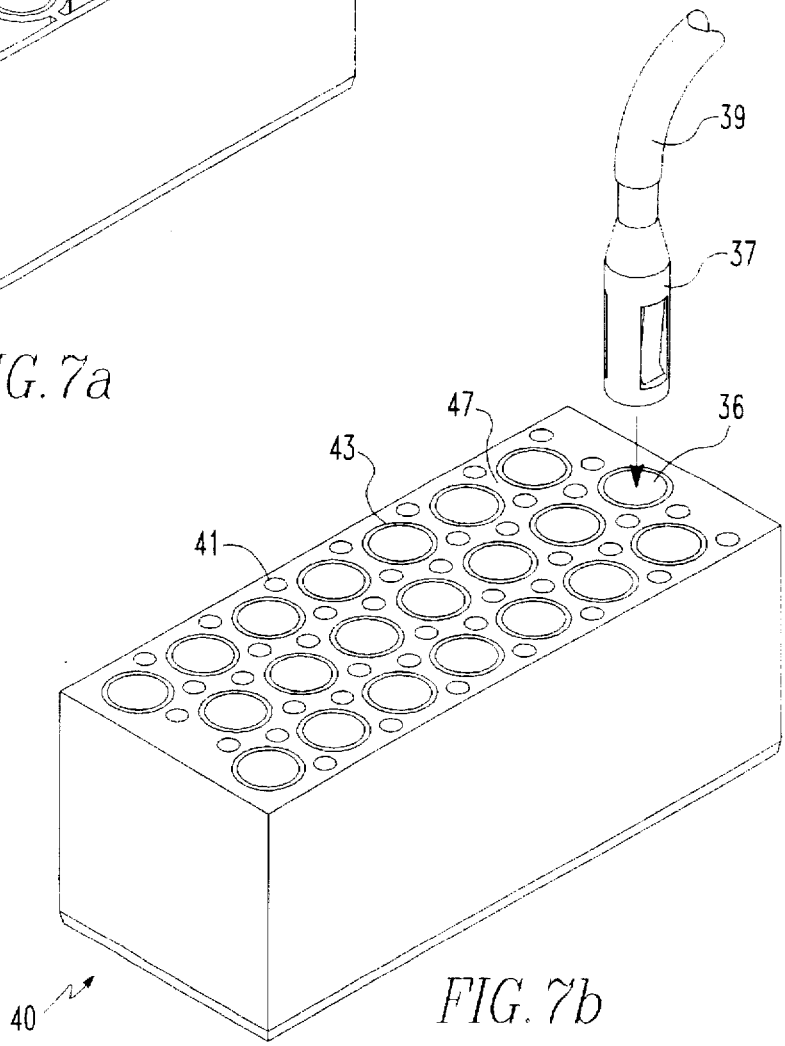

FIG. 7*b* shows a connector 40 having cylindrical non-metallized cavities 36 accommodating terminals 37 which may be connected to a cable 39. Each cavity 36 is surrounded by a plurality of cylindrical additional metallized through-holes 41. Additional through-holes 41 have a smaller diameter than the diameter of the cavities 36. The bridges 47 between adjacent cavities 36 are much thicker than the corresponding bridges 46 in FIG. 7*a*. This provides for more mechanical stability although cross-talk reduction between terminals in adjacent cavities will be less than in the embodiment according to FIGS. 5, 6, and 7*a*.

Figure 8A:
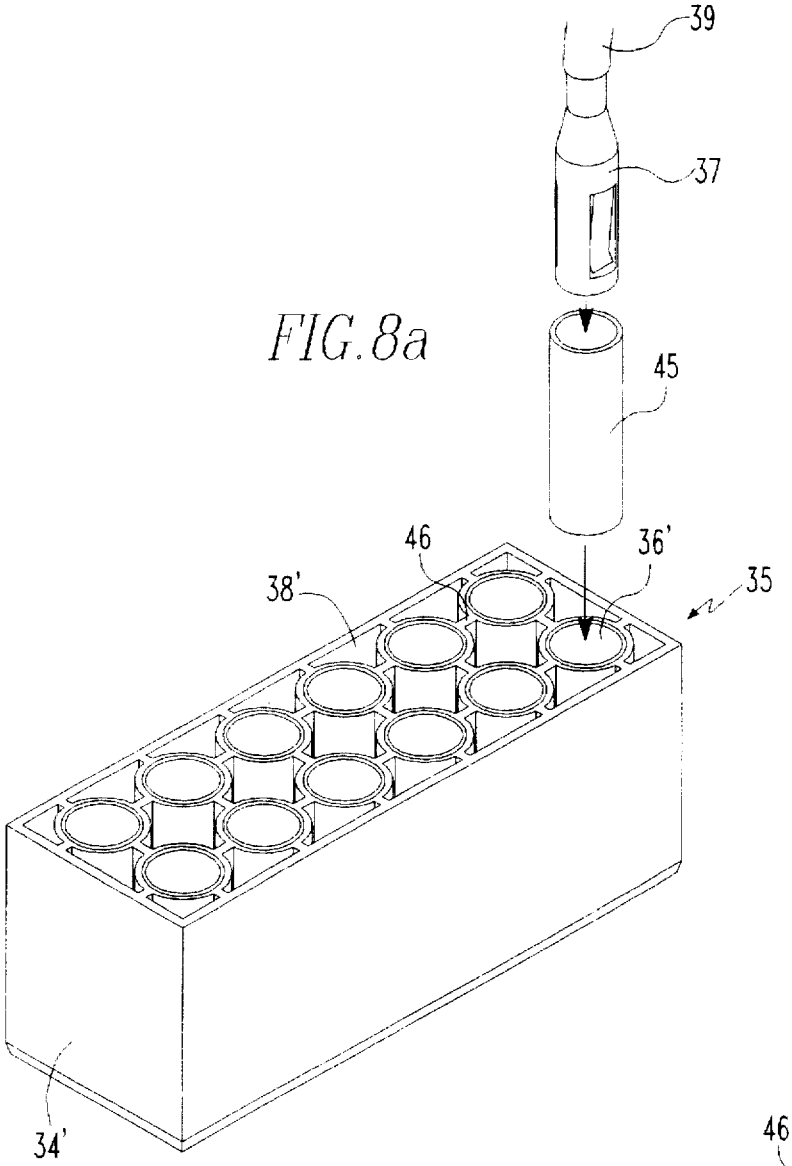
FIGS. 8*a* and 8*b* show further alternative connectors according to the invention.
Figure 8B:
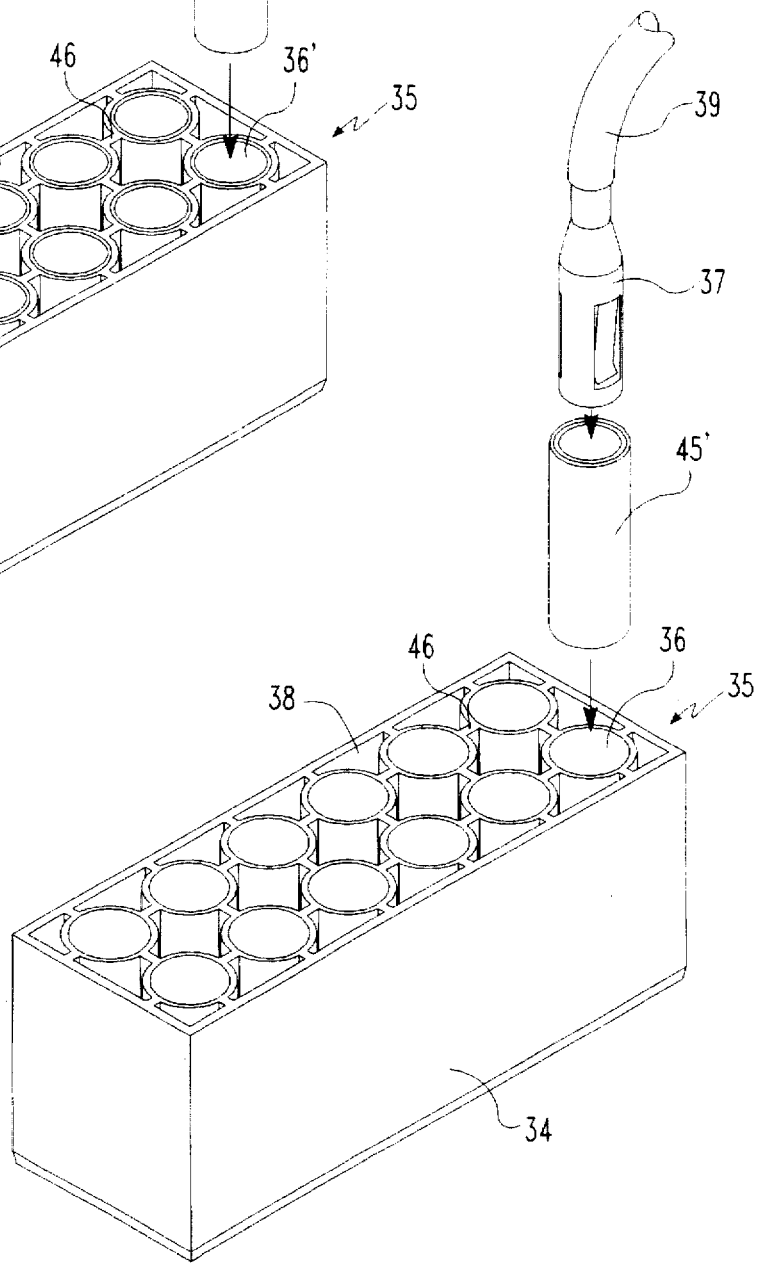

FIGS. 8*a* and 8*b* show connectors 35 provided with coaxial shielded terminals 37. In the embodiment of FIG. 8*a* each cavity 36', which may have a circular cross-section, is entirely metallized. To prevent a short circuit to the terminal 37, which may be connected to a cable 39, an insulating sleeve 45 is provided between the side wall of cavity 36' and the terminal 37. As a further shielding measure the housing 34' of connector 35 according to the embodiment of FIG. 8*a* may be metallized.

Instead of the metallized connector 35 according to the embodiment of FIG. 8*a* also a non-metallized connector 35 according to the embodiment of FIG. 8*b* can be used. In that case connector 35 may comprise non-metallized additional holes 38 and a non-metallized housing 34. Then, an externally metallized plastic sleeve 45' is used between the side wall of the cavity 36 and the terminal 37. Note that in the embodiments according to FIGS. 8*a* and 8*b* the terminals 37 are entirely surrounded by a metal shielding thus providing for a Faraday cage effect.

Figure 9A:
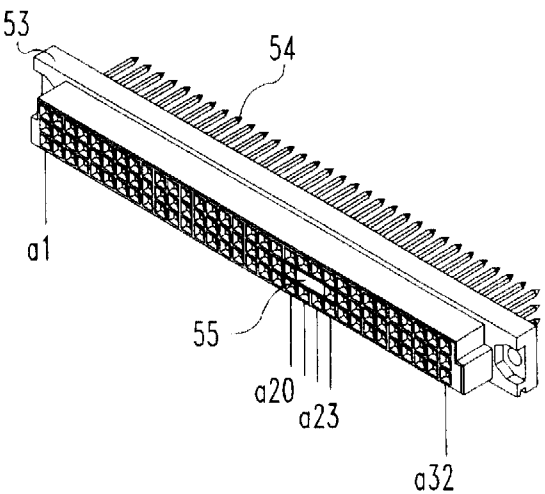
FIGS. 9*a*, 9*b* to 9*c* show connectors provided with a twin-axial insert.
Figure 9A:
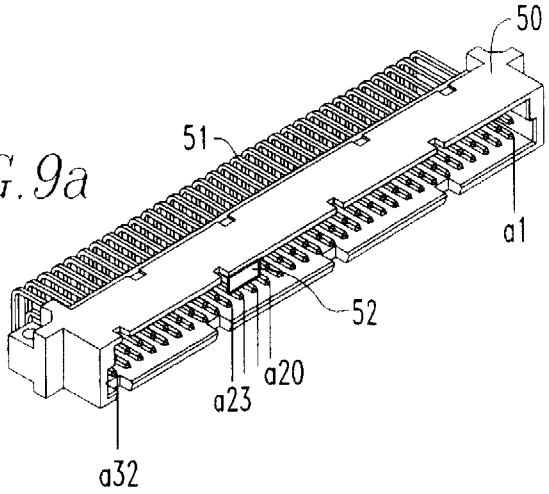
Figure 9B:
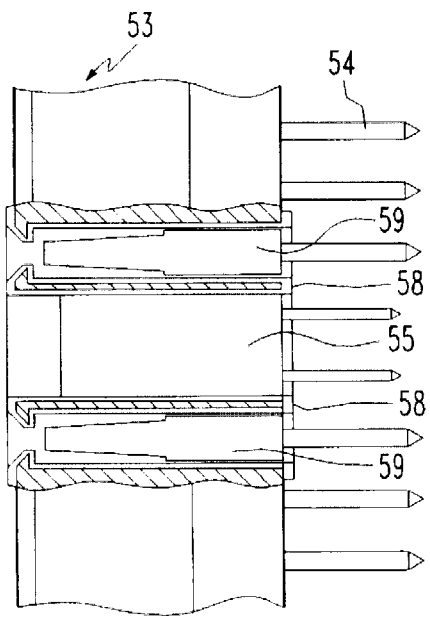
Figure 9B:
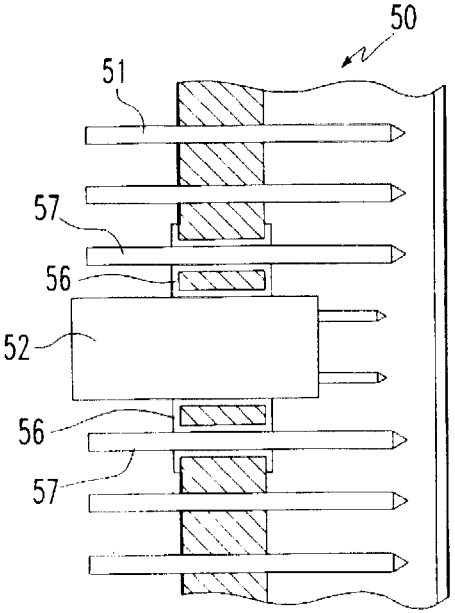
Figure 9C:
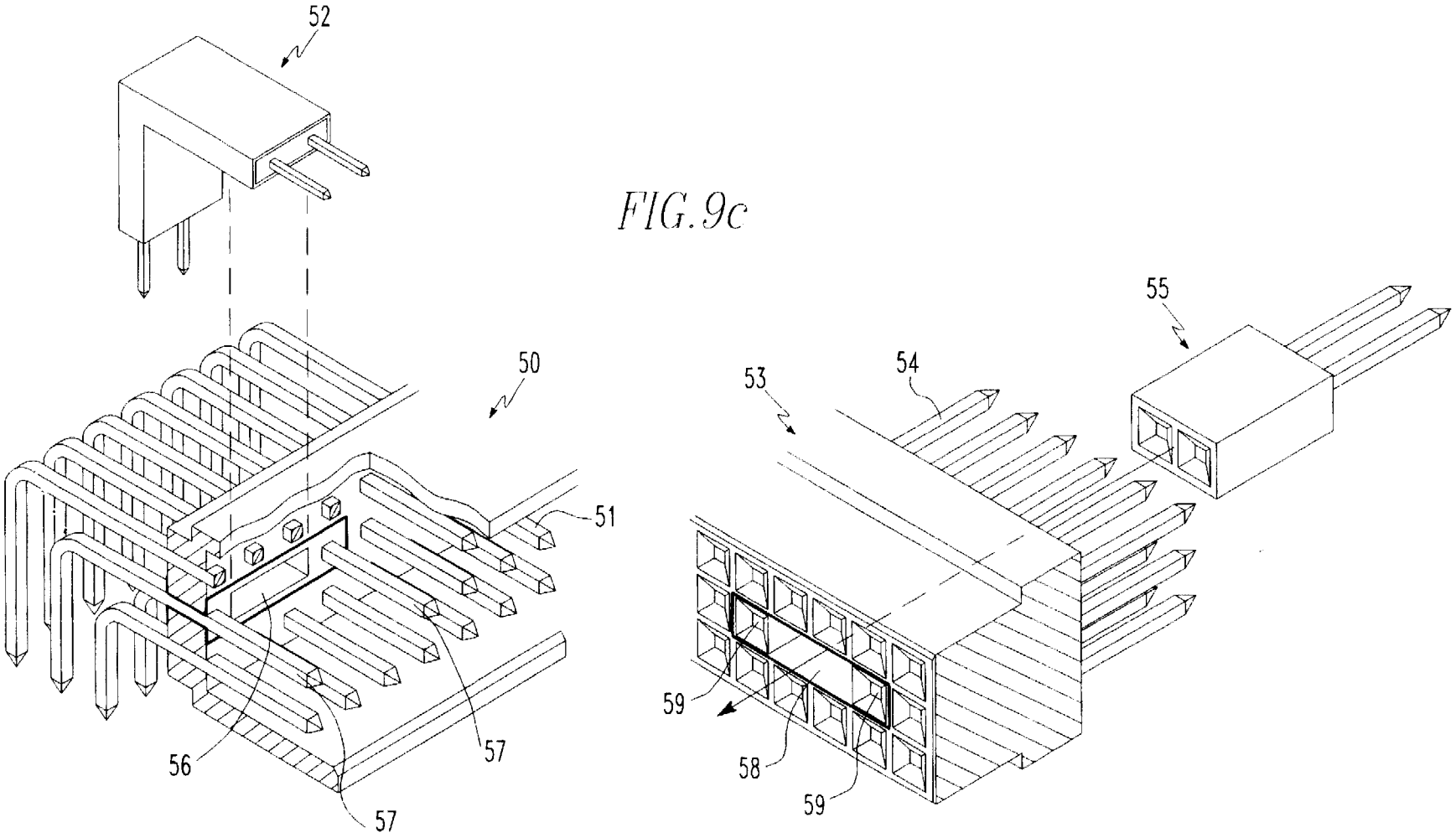

FIGS. 9*a* to 9*c* show that the teaching of the present invention can also be used to provide a twin-ax connection within a connector having a plurality of cavities arranged in columns and rows.

The connectors 50 and 53 shown in FIG. 9*a* are known as "Autobahn"-connectors having a plurality of cavities arranged in thirty two columns of three rows a, b, c. Connector 50 is a male-type of connector comprising terminal pins 51. Connector 53 is a female-type of connector and comprises female terminals 54. The cavities on the positions b20, b21, b22, b23 have a predetermined purpose: both cavities b20 and b23 do have to comprise ground terminals, whereas both cavities b21 and b22 do have to comprise "Autobahn"-bus terminals.

FIG. 9*b* shows top cross-sections through row b of connectors 50 and 53, respectively. Connector 50 is shown to have ground pins 57 on each of the positions b20 and b23. Connector 53 is shown to have female ground terminals 59 on positions b20 and b23, respectively. On the positions b21 and b22 each of the connectors 50 and 53 comprise one combined large cavity large enough to accommodate a male-type of twin-ax insert 52 or a female-type of twin-ax insert 55, respectively. Both the twin-ax inserts 52 and 55 are made of externally metallized plastic insert members (FIG. 9*c*). Connector 50 is provided with a metal layer 56 extending through the cavities on the positions b20 and b23 as well as in the combined cavity on positions b21 and b22, as shown in FIG. 9*b*. The ground pins 27 contact the metal layer 56. Also the externally metallized twin-ax insert 52 contacts the metal layer 56 Therefore, the externally metallized twin-ax insert 52 is shielded since its outside metal layer is grounded.

Connector 53 is provided with a metal ground layer 58 which extends through the cavities on the positions b20 and b23 as well as through the combined cavity on the positions b21 and b22 into which twin-ax insert 55 is inserted. Therefore, the outside metallized surface of twin-ax insert 55 is grounded and acts as an electromagnetic shielding.

When the connectors 50 and 53 are connected to each other the ground pins 57 are inserted in the female ground terminals 59 thereby establishing a well defined ground potential for both connectors.

In the embodiments of the connector according to the present inventions several selectively metallized plastic members are discussed. It is observed that to manufacture said selectively metallized plastic members the method described in copending European patent application (BO 39328) of the present Applicant may be applied. In general, this means that the Following steps can be carried out to yield the desired selectively metallized plastic members:

a. depositing a first, electroless metal layer of a first predetermined thickness on the surface of the plastic member;

b. ablating predetermined traces of said first metal layer in order to produce first metal layer subareas located at predetermined surface subareas of the plastic member, which first metal layer subareas are electrically separated from the remaining area of said first metal layer;

c. depositing a second, galvanic metal layer of a second predetermined thickness to the first metal layer subareas only;

d. removing the remaining area of said first metal layer. In the present invention the first metal layer subareas mentioned above correspond to those metal layers on the surface of the different plastic members shown in the figures. For instance, in the embodiment according to FIG. 1 said first metal layer subareas correspond to metal layers 11, 12, and 15.

When the method according to said copending European patent application (BO 39328) is used a high energy beam may be used, for example an electron beam or ion beam to separate the first metal layer subareas from the remaining first metal layer area. A light beam or a laser beam may be used instead, whereas also grinding may be used. Removing any non-selected metal layer areas in step d. referred to above may be done by chemical etching or by grinding processes. The first metal layer may be made of electroless copper or nickel and may have a thickness of 1 to 2 μm. The second thickness referred to above may be 5 to 10 μm. The galvanic metal layer may be coated with a top coat finish layer, for instance, made of nickel, gold, or tin-lead, which finish layer may have a thickness between 2 to 4 μm. For further details as to said method for manufacturing selectively metallized plastic members reference is made to said copending European patent application (BO 39328).

Of course, manufacturing of the selectively metallized plastic members of the connectors according to the present invention is not restricted to the method according to said copending European patent application. Any other suitable method may be applied.

It is to be understood that the embodiments shown in the figures are given by way of example only. The scope of the present invention is only limited by the scope of the annexed claims. For instance, it is observed that the application of a twin-ax insert as shown in FIGS. 9*a* to 9*c* is not restricted to connector types shown in FIGS. 9*a* to 9*c*. These twin-ax inserts may, for instance, also be applied in connectors as shown in any of the other preceding figures.

What is claimed is:

1. A connector provided with at least two adjacent cavities to accommodate terminals, the connector having a length and a metallized plastic structure in order to at least partly shield at least one cavity from the other cavities characterized in that said connector is selectively metallized over its entire length and comprises at least partly the following housing structure between each shielded cavity and its adjacent cavities: a first insulating plastic wall, at least one metal layer, a second insulating plastic wall, said at least one metal layer being provided as a coating on one of said plastic walls.

2. The connector according to claim 1 characterized in that the connector comprises at least a first and a second housing part and at least two adjacent coaxial terminals,the first housing part comprising at least one cavity to accommodate one terminal and being selectively metallized at the outside surface surrounding said at least one cavity, the second housing part comprising at least one further cavity to outside surface surrounding said at least one further cavity, the first and second housing parts being designed in such a way as to be able to be inserted into each other in order to yield said connector comprising at least two adjacent coaxial terminals.

3. The connector according to claim 2 characterized in that said connector comprises a comb-like third housing part that can be fixed to said first and second housing parts inserted into each other to provide separating walls between adjacent columns of terminals extending from said first and second housing parts inserted into each other.

4. The connector according to claim 3 characterized in that said separating walls comprise molded-in plates.

5. The connector according to claim 1 any of the preceding claims characterized in that said connector is surface mounted to a substrate by means of surface mount connection means connected to both the selectively metallized connector and a ground layer on said substrate.

6. The connector according to claim 1 characterized in that said connector comprises several adjacent cavities to receive terminals, said cavities being separated by cavity walls provided with additional, internally metallized through-holes having predetermined cross-sections and surrounding said cavities.

7. The connector according claim 1 characterized in that the connector comprises a housing provided with adjacent, internally metallized cavities, and insulating sleeves to be inserted into corresponding cavities and to accommodate corresponding terminals.

8. The connector according claim 1 characterized in that the connector comprises an insulating housing provided with adjacent cavities and externally metallized sleeves to be inserted into corresponding cavities and to accommodate corresponding terminals.

9. The connector according claim 1 characterized in that the connector comprises at least one cavity accommodating a twin-axial insert member externally metallized and electrically contacting a ground layer on the connector's surface, which ground layer also electrically contacts at least one ground terminal adjacent to said twin-axial insert member.

10. A connector provided with at least two adjacent cavities to accommodate terminals, the connector having a metallized plastic structure in order to at least partly shield at least one cavity from the other cavities characterized in that said connector is selectively metallized and comprises at least partly the following housing structure between each shielded cavity and its adjacent cavities: a first insulating plastic wall, at least one metal layer, a second insulating plastic wall, said at least one metal layer being provided as a coating on at least one of said plastic walls and said connector comprises at least a first and a second housing part and at two adjacent coaxial terminals, the first housing part comprising at least one cavity to accommodate one terminal being selectively metallized at the surface surrounding said at least one cavity, the second housing part comprising at least one further cavity to accommodate one further terminal and being selectively metallized at the outside surface surrounding said at least one further cavity, the first and second housing parts being designed in such a way as to be able to be inserted into each other in order to yield said connector comprising at least two adjacent coaxial terminals.

11. The connector according to claim 10 characterized in that said connector comprises a comb-like third housing part that can be fixed to said first and second housing parts inserted into each other to provide separating walls between adjacent columns of terminals extending from said first and second housing parts inserted into each other.

12. The connector according to claim 11 characterized in that said separating walls comprise molded-in plates.

13. The connector according to claim 10 characterized in that said connector is surface mounted to a substrate by means of surface mount connection means connected to both the selectively metallized connector and a ground layer on said substrate.

14. The connector according to claim 10 characterized in that said connector; comprises several adjacent cavities to receive terminals, said cavities being separated by cavity walls provided with additional, internally metallized through-holes having predetermined cross-sections and surrounding said cavities.

15. The connector according to claim 10 characterized in that the connector comprises a housing provided with adjacent, internally metallized cavities, and insulating sleeves to be inserted into corresponding cavities and to accommodate corresponding terminals.

16. The connector according to claim 10 characterized in that the connector comprises an insulating housing provided with adjacent cavities, and externally metallized sleeves to be inserted into corresponding cavities and to accommodate corresponding terminals.

* * * * *